United States Patent [19]

Weir

[11] 3,931,651

[45] Jan. 13, 1976

[54] DISPOSABLE BATHTUB LINER

[75] Inventor: Francis X. Weir, Seattle, Wash.

[73] Assignee: The Raymond Lee Organization, Inc., New York, N.Y. ; a part interest

[22] Filed: Jan. 6, 1975

[21] Appl. No.: 538,550

[52] U.S. Cl. ..... 4/173; 4/172.12; 4/177

[51] Int. Cl.[2] ..... A47K 3/00

[58] Field of Search ..... 4/173, 172.12, 177

[56] References Cited

UNITED STATES PATENTS

| | | | |
|---|---|---|---|
| 2,671,907 | 3/1954 | Sterling | 4/173 |
| 3,024,471 | 3/1962 | Anderson | 4/173 |
| 3,045,254 | 7/1962 | Cook et al. | 4/173 |

*Primary Examiner*—Richard E. Aegerter
*Assistant Examiner*—Larry Jones

[57] ABSTRACT

A thin flexible liner having a horizontal flange overlying the top surface of a bathtub and a main portion covering the inner wall of the bathtub. The liner is open at bottom leaving the bottom of the bathtub exposed. The flange is held removably in contact with the top surface of the bathtub by magnetic or suction securing means. The liner can have a small slotted region in registration with an overflow outlet in the bathtub.

2 Claims, 3 Drawing Figures

DISPOSABLE BATHTUB LINER

BACKGROUND OF THE INVENTION

This invention is directed towards a liner which can be removably disposed in a bathtub to minimize the collection of dirt therein and to facilitate ease of cleaning while reducing the time required for cleaning.

SUMMARY OF THE INVENTION

In accordance with the principles of this invention, a thin flexible liner, which can be disposable, fits removably into a bathtub. The liner has a horizontal flange overlying the top surface of the bathtub and a main section covering the inner wall of the bathtub. The liner is open at the bottom leaving the bottom of the bathtub exposed. Magnetic securing means holds the flange in position against the top surface of the bathtub to hold the liner in place when the bathtub is formed of procelain covered iron or other magnetic material. Suction means securing means holds the flange in position to hold the liner in place when the tub is non magnetic.

In use when the bathtub is drained, the soap and scum will accumulate primarily on the exposed surface of the liner with a small portion settling onto the bottom of the tub. The liner is readily washed off whereby the soap and scum is collected on the bottom of the tub and is easily washed down the drain with running water from the tap.

The liner can have a slotted opening covering the overflow opening in the tub whereby water can flow unimpeded through the opening and at the same time the liner will not pull loose around the opening.

DETAILED DESCRIPTION OF PREFERRED EMBODIMENTS

Figure 1:
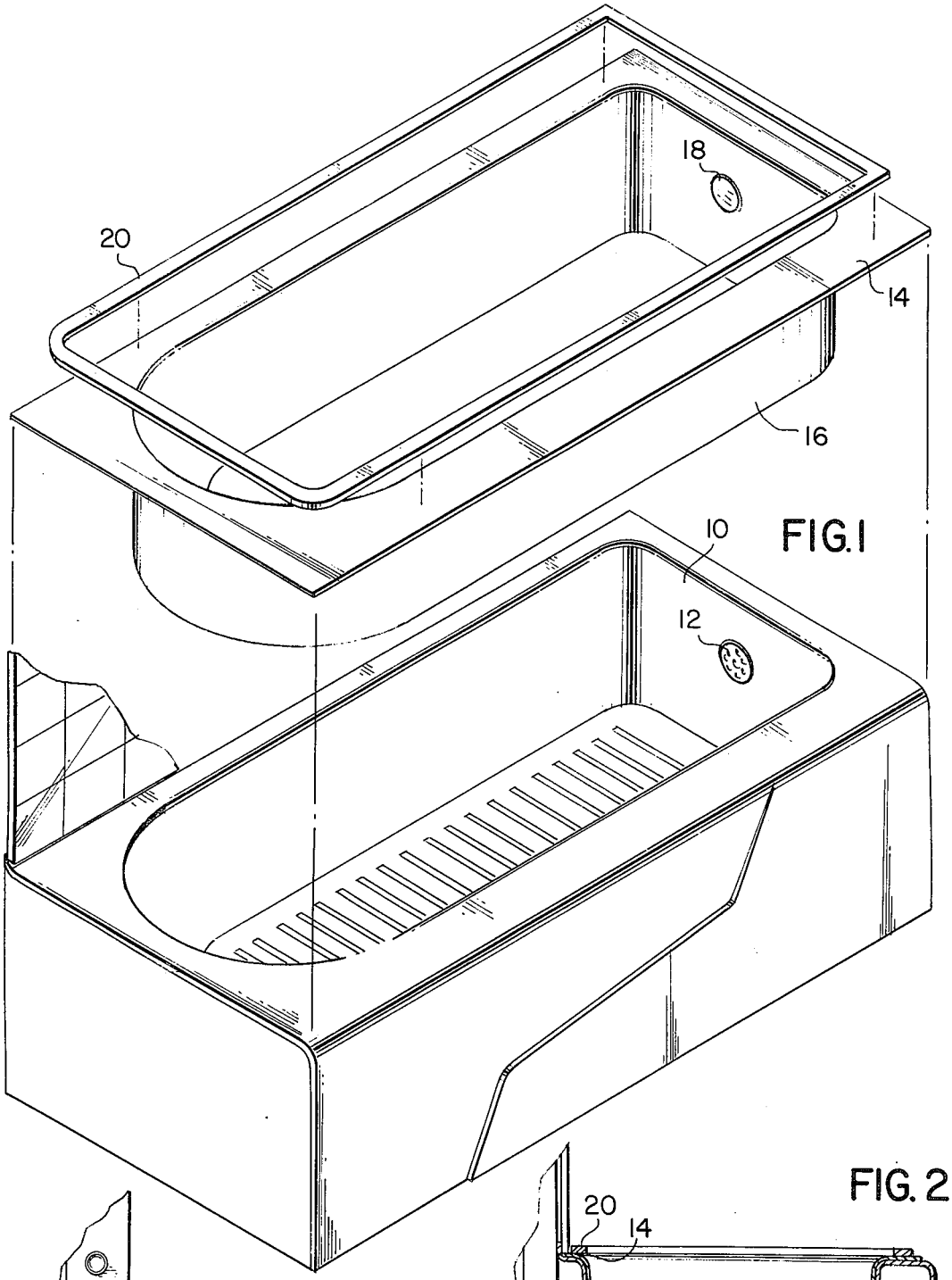
FIG. 1 is an exploded perspective view of the invention.
Figure 2:
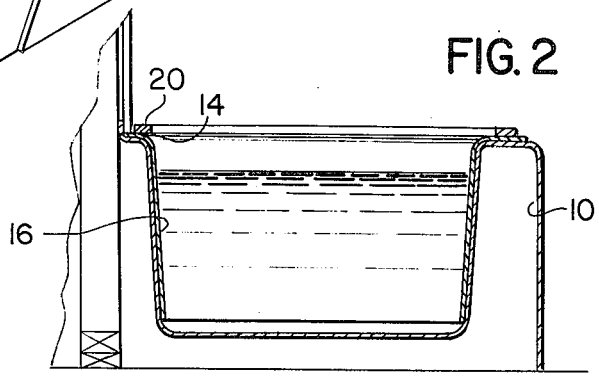
FIG. 2 is an assembled cross sectional view of the invention.

Referring first to FIGS. 1 and 2, a porcelain clad iron or steel bathtub 10 has an overflow outlet 12. A thin plastic disposable liner has a horizontal flange 14 which overlies the top surface of the tub. The flange has a central oval shaped opening with a vertical peripheral wall 16 adapted to engage the inner wall of the tub. The bottom of the liner is open exposing the bottom surface of the tub. The liner wall has an opening formed by slots 18 which span outlet 12 and allow access thereto.

An oval shaped flat horizontal magnet 20, which can be constructed of magnet gasket material used in refrigerators or can be of conventional magnet material, overlies the flange and holds the flange to the tub detachably by use of magnetic forces of attraction.

Figure 3:
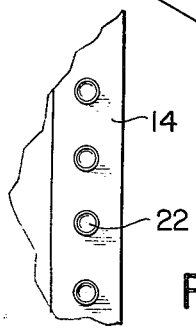
FIG. 3 is an enlarged detail view of a modification of the invention.

Alternatively, when the tub is formed of non magnetic material, as shown in FIG. 3, the bottom surface of the flange can have suction dimples or recesses 22. When these recesses are flattened out against the top surface of the tub, suction forces are developed which hold the flange in position. The magnet 20 is not used in this application and is removed.

While the invention has been described with detailed reference to the drawings, the protection sought is to be limited only by the terms of the claims which follow.

I claim:

1. In combination with a magnetic bathtub, a thin flexible plastic liner having a horizontal flange overlying the top surface to the bathtub and having a central oval opening with a vertical peripheral wall extending downward and overlying the inner wall surface of the bathtub, the bottom of the bathtub being exposed, the inner wall surface of the bathtub having an overflow outlet, the wall of the liner having a slotted opening overlying the outlet, and means with form of a flat magnet overlying said flange to detachably secure the flange to the top surface of the bathtub.

2. In combination with a bathtub, a thin flexible plastic liner having a horizontal flange overlying the top surface of the bathtub and having a central oval opening with a vertical peripheral wall extending downward and overlying the inner wall surface of the bathtub, the bottom of the bathtub being exposed, the inner wall surface of the bathtub having an overflow outlet, the wall of the liner having a slotted opening overlying the outlet, and means in the form of suction producing recesses in the bottom surface of the flange to detachably secure the flange to the top surface of the bathtub.

* * * * *